United States Patent [19]

Watson

[11] Patent Number: 4,593,500

[45] Date of Patent: Jun. 10, 1986

[54] EARTH ANCHOR WITH LOAD PLATE

[75] Inventor: Gary Q. Watson, Odessa, Tex.

[73] Assignee: Morrow Manufacturing Co., Inc., Tex.

[21] Appl. No.: 519,041

[22] Filed: Aug. 1, 1983

[51] Int. Cl.[4] ..... E02D 5/80

[52] U.S. Cl. ..... 52/162; 52/155

[58] Field of Search ..... 52/155, 156, 157, 159, 52/162, 163, 166

[56] References Cited

U.S. PATENT DOCUMENTS

| | | | |
|---|---|---|---|
| 700,077 | 5/1902 | Peebles | 52/153 |
| 1,165,459 | 12/1915 | Sprague | 52/153 |
| 1,807,488 | 5/1931 | Michalicek | 52/159 |
| 2,176,566 | 10/1939 | Dillon | 52/160 |
| 2,357,368 | 9/1944 | Warren | 52/161 X |
| 2,580,948 | 1/1952 | Pancake | 52/161 X |
| 2,588,712 | 3/1952 | Ferris | 52/161 |
| 2,863,535 | 12/1958 | Clapper | 52/161 |
| 2,966,243 | 12/1960 | Clapper | 52/161 |
| 3,132,726 | 5/1964 | Johnson | 52/153 |
| 3,525,224 | 8/1970 | Bardgette | 52/156 X |
| 3,866,368 | 2/1975 | Toops | 52/162 |
| 3,896,596 | 7/1975 | Berger | 52/153 |
| 4,023,314 | 5/1977 | Tanner | 52/162 |
| 4,251,963 | 2/1981 | Patterson | 52/157 |

*Primary Examiner*—J. Karl Bell

*Attorney, Agent, or Firm*—Arthur F. Zobal

[57] ABSTRACT

An elongated rod has a reaction member attached to a lower end with flukes adapted to be expanded outward against the reaction member. An upper end member is connected around the upper end of the rod and supports a connecting member. An enlarged bushing plate is coupled to the upper end member and to the rod at a lower position for transferring a portion of the load applied to the connecting means to the wall of the hole.

26 Claims, 11 Drawing Figures

FIG. 8
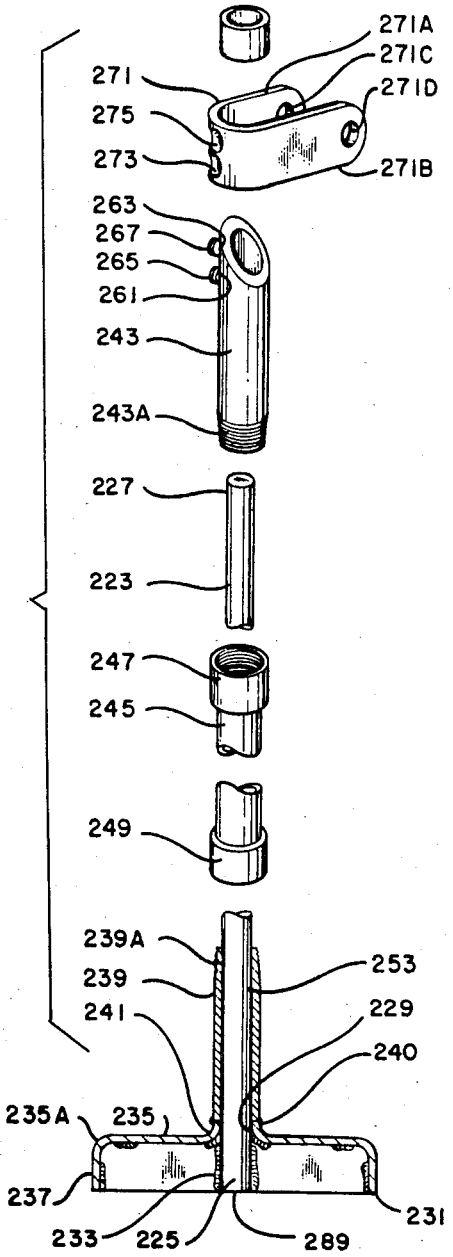
FIG. 9
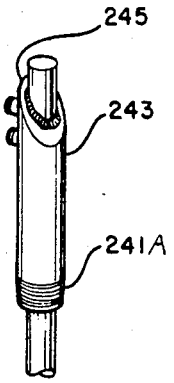
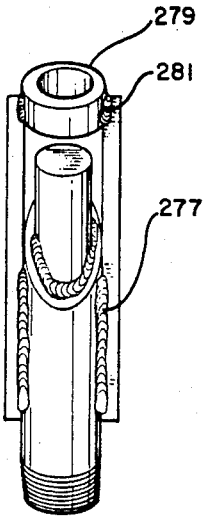
FIG. 10

EARTH ANCHOR WITH LOAD PLATE

BACKGROUND OF THE INVENTION

1. Field of the Invention

The present invention relates to an anchor to be located in a hole formed in the earth for anchoring large loads above the earth's surface.

2. Description of the Prior Art

U.S. Pat. Nos. 2,285,889, 3,056,477, 3,526,069, 3,680,274, and 4,174,595 disclose different types of earth anchors.

SUMMARY OF THE INVENTION

It is an object of the present invention to provide a new and useful anchor to be located in a hole formed in the earth for anchoring large loads above the earth's surface.

It is a further object of the present invention to provide an earth anchor comprising an elongated rod means with movable flukes at one end for securing said rod means in a hole and with an enlarged plate means coupled to the upper portion of said rod means for transferring a portion of the load, applied to the upper end of said rod means, to the wall of the hole.

The anchor comprises an elongated rod means having a first end and a spaced second end with said first end being adapted to be located at the lower end of a hole formed in the earth. Connecting means is coupled to said second end of said rod means and is adapted to be located above the earth when the anchor is secured in place. End means is coupled to said first end of said rod means and extends transversely outward therefrom. Support means is provided having a plurality of flukes pivotally coupled thereto. Said support means is adapted to be located around said sleeve means near said first end of said rod means and moved toward said first end of said rod means near said end means such that said flukes will engage said end means and be pivoted outward into the earth surrounding the hole as said support means is moved further toward said first end of said rod means. An enlarged plate means is coupled to said rod means near said second end thereof and at a position between said second end thereof and at a position between said second end and said first end of said rod means for transferring a portion of a load applied to said connecting means to the wall of the hole. Said plate means has a width much greater than the maximum dimension of said rod means in a plane perpendicular to the length of said rod means and a length greater than its width. Said plate means is located on one side of said rod means with its length being generally parallel with the length of said rod means.

In one embodiment, said plate means is formed generally in a semicircle with its axis being generally parallel to the length of said rod means. BRIEF DESCRIPTION OF THE DRAWINGS FIGS. 1A and 1B are partial cross sections of upper and lower portions respectively of the earth anchor of the present invention. The hole bushing plate is not shown attached to the anchor rod in FIGS. 1A and 1B.

FIG. 8 is an exploded view of the anchor of FIGS. 6 and 7 without its flukes and without the hole bushing plate.

FIG. 9 illustrates the manner in which the upper end member is attached to the rod of the anchor.

FIG. 10 illustrates the manner in which the eye transfer unit is attached to the upper end member of FIG. 9.

DESCRIPTION OF THE PREFERRED EMBODIMENTS

Figure 1A:
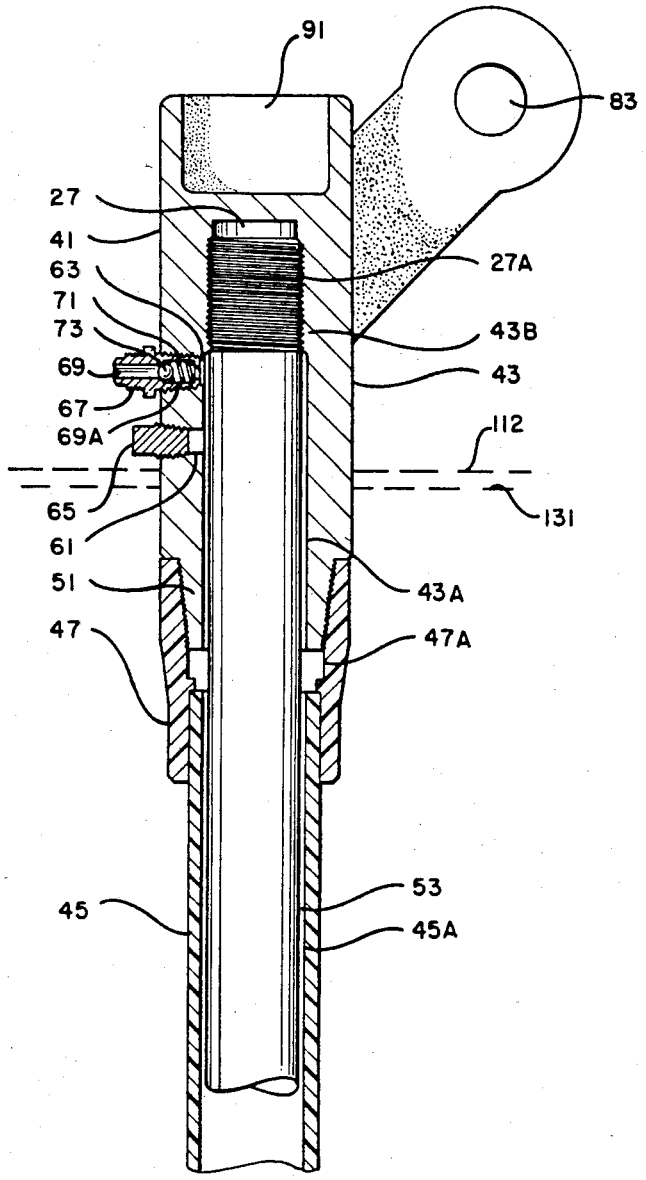

Referring now to FIGS. 1–5, the earth anchor is identified at 21. It comprises an elongated steel rod 23, circular in cross section, and which has threads 25A formed at its lower end 25 and threads 27A formed at its upper end 27. The lower threads 25A are screwed into a threaded opening 29 formed in a hub 31 of a reaction member 33. The reaction member 33 has a conical shaped wall 35 which extends outward and toward the upper end 27 of the rod 23 such that its circular outer edge 35A defines an annular space 37 between the edge 35A and a tubular portion 39 which extends axially from the center portion of the wall 35. An end member 41 having an opening comprising an enlarged portion 43A and an internally threaded portion 43B is located around the upper end 27 of the rod 23 with the threads 27A screwed into the threaded opening 43B. The inside wall of the enlarged opening 43A of the lower portion 43C of the end member 41 is spaced from the rod 23. A plastic sleeve comprising an elongated plastic tubular member 45 having its upper end secured to an upper plastic coupling member 47 and its lower end secured to a lower plastic coupling member 49 is located around the rod 23. The lower coupling member 49 is screwed to the tubular extension 39 of the reaction member 33 and the upper coupling 47 is screwed to the lower threaded end 51 of the end member 41 with fluid tight connections being formed. The coupling members 47 and 49 are secured around the upper and lower ends of the sleeve 45 with the use of a suitable sealing or bonding agent to form fluid tight joints. A suitable sealing agent is used between the threaded connection of the coupling member 49 and extension 39 and between the threaded connection of the coupling member 47 and the threaded end 51 of member 41. Preferably sleeve 45 and coupling members 47 and 49 are formed of PVC. End member 41 and reaction member 33 preferably are formed of steel. The inside wall of the enlarged opening 43A of the lower portion 43C of end member 41, the inside wall 45A of sleeve 45, the inside wall 47A of coupling member 47, the inside wall 49A of coupling member 49 and the inside wall 39A of tubular extension 39 are spaced from the rod 23 such that a sealed chamber 53 is formed between the rod 23 and the lower portion 43C of the tubular member 41, the coupling member 47, the sleeve 45, the coupling member 49, and the tubular extension 39 of the reaction member 33.

Lower and upper inlets 61 and 63 are formed through the wall of the lower portion 43C of member 41 to the opening 43A such that the inlets 61 and 63 are in fluid communication with the chamber 53. The inlet 61 normally is sealed with a metal plug 65 screwed into the inlet 61. The inlet 63 normally is sealed with a plug 67 which is screwed into the inlet 63. The plug 67 has an aperture 69 formed therethrough with an enlarged portion 69A which supports a check valve comprising a spring 71 and a ball 73 which normally closes the opening 69. The opening 69 can be opened for injecting gas into the chamber 63 by applying gas under pressure from the exterior of the plug 67 through the opening 69 to move the ball 73 inward against the spring 71. For purposes of clarity, the inlets 61 and 63 and their plugs 65 and 67 are not shown in FIGS. 4 and 5.

Figure 4:
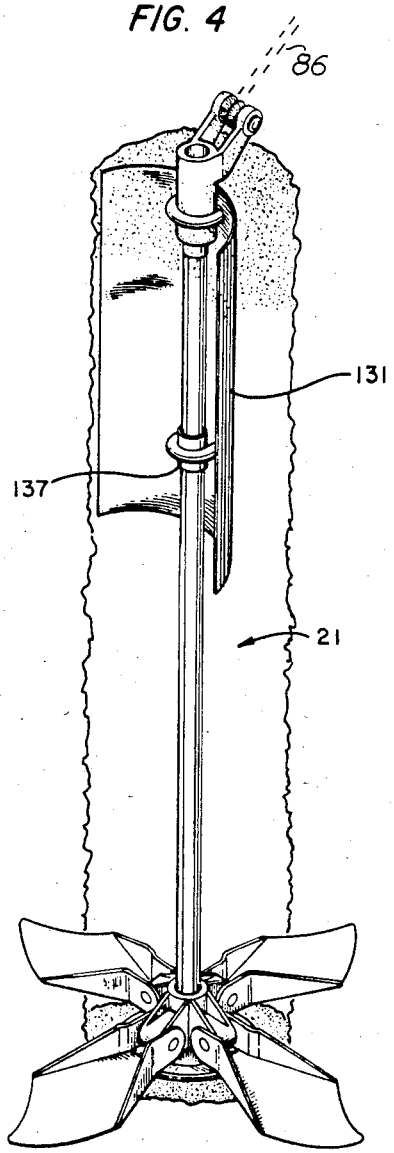
FIG. 4 illustrates the anchor in a hole in the earth with its flukes expanded into the earth and with an enlarged bushing plate attached to the upper portion of the anchor.

The top end of the member 41 has two spaced arms 81 extending parallel to each other in an upward and outward direction about 45° relative to the axis of the member 41. The arms 81 have holes 83 formed through their ends for receiving a bolt 85 with the bolt 85 also extending through a single grooved rotatable spool 87 or a dual grooved rotatable spool 89. One of spools 87 or 89 is located around the shaft of the bolt 85 between the arms 81 and is employed for connection to a cable or a guy wire. In FIG. 4, a guy wire is illustrated at 86 although the actual connection of the guy wire to the spool is not shown. The arms 81, bolt 85, and the spool employed are defined as a connecting means to which a guy wire is to be connected. The upper end of the member 41 has an upper opening 91 formed therein for receiving a rod 93 having a flag 95 which acts as an anchor marker.

Figure 1B:
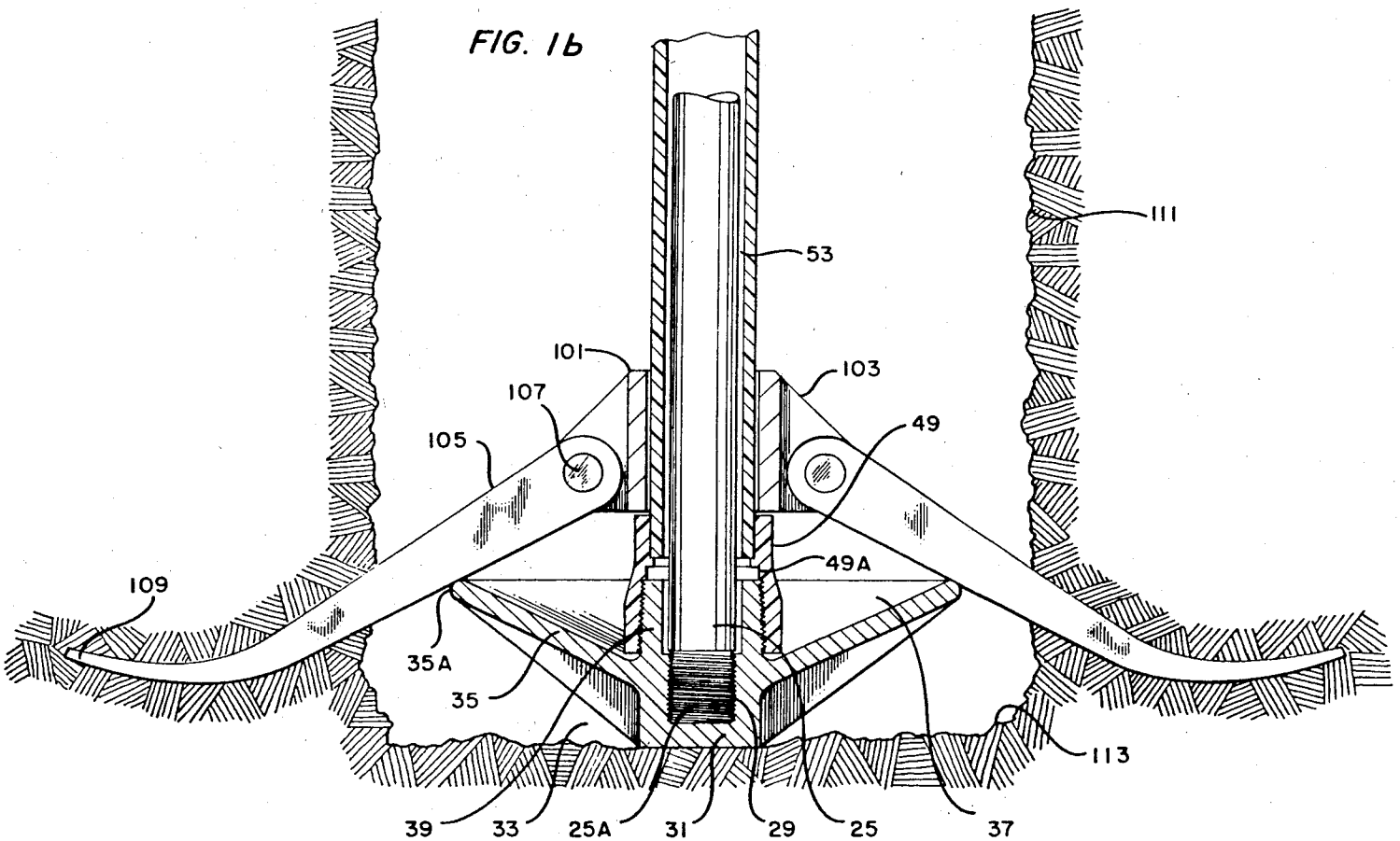
Figure 3:
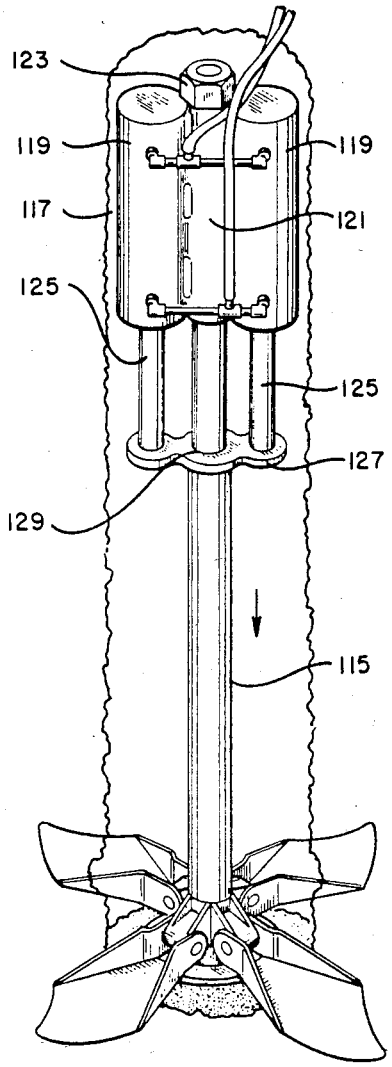
FIG. 3 illustrates a portion of the anchor in a hole formed in the earth with its flukes expanded into the earth with the use of a hydraulic cylinder mechanism.

A metal ring shaped member or support means 101 having four equally spaced ear members 103 is provided for pivotally supporting four flukes or wings 105. The inward ends of the flukes 105 are pivotally coupled to the ears 103 by rods 107. The outward ends 109 of the flukes 105 curve upward as seen in FIG. 1B. The ring 101 has an inside diameter large enough to slide around the plastic sleeve 45. When the ring 101 is in an upward position as shown in FIG. 3, the flukes 105 are in a retracted position with their ends 109 resting against the outer edge 35A of the conical shaped wall 35. As the ring 105 is moved toward the reaction member 33, the flukes 105 engage the outer edge 35A of the reaction member and slide outward thereon as they are pivoted on the rods 107.

The anchor 21 is designed to be used in a vertical hole 111 formed in the earth having a diameter slightly greater than the cross sectional size of the flukes 105 when they are in their retracted position and having a depth slightly less than the length of the rod 23.

Figure 2:
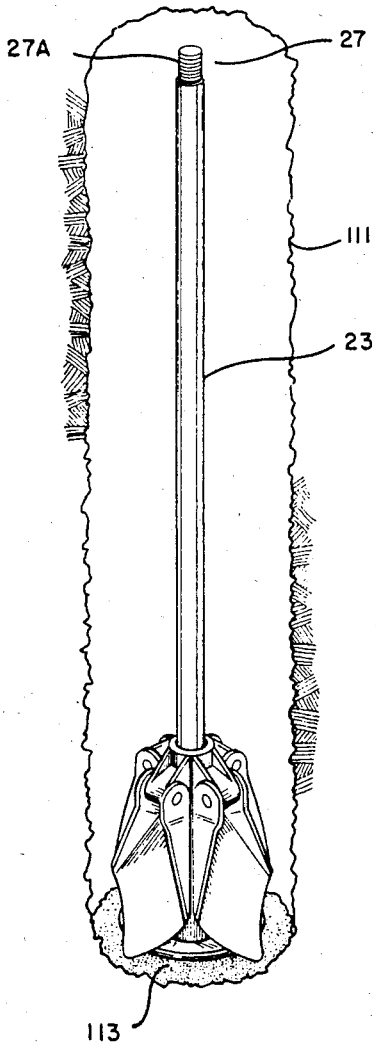
FIG. 2 illustrates a portion of the anchor in a hole formed in the earth with its flukes in a retracted position.

The anchor is secured in a hole in the following manner. The rod 23 is screwed into the reaction member 33 and the plastic sleeve 45, bonded to the upper coupling member 47 and to the lower coupling member 49, is located around the rod 23 with the lower coupling member 49 screwed to the extension 39 of the reaction member 33. At this point, the upper end member 41 is not screwed to the upper end 27 of the rod 23 or to the coupling member 47. The ring 101 with its flukes 105 is located around the sleeve 45 and the assembly is then inserted into the hole 111 with the ring 101 held in a upward position, for example, by a long wire, to maintain the flukes 105 in their retracted position as shown in FIG. 2. In this position, the hub 31 of the reaction member 33 rests on the bottom 113 of the hole 111. An elongated metal tube 115 then is located around the sleeve 45 until it abuts against the top of the ring 101. A hydraulic cylinder mechanism 117 next is coupled to the upper end of the rod 23 to force the tube 115 downward against the ring 101 to move it downward toward the reaction member 33 thereby causing the flukes 105 to move against the edge 35A of the reaction member 33 outward into the earth for securing the anchor in the hole as shown in FIG. 1B. As shown in FIG. 3, the hydraulic cylinder 117 comprises two cylindrical members 119 attached to opposite sides of a tubular member 121 which is adapted to fit around the upper end of the rod 23. A nut 123 then is screwed to the upper threads 27A. The cylinders 119 have pistons 125 which are attached to an end plate 127 which has a central aperture 129 which freely fits around the plastic sleeve 45. The end plate 129 abuts against the upper end of the tubular member 115 and when the hydraulic cylinders 119 are actuated to move their pistons 125 outward, the upper end of the tubular member 121 engages the nut 123 and the plate member 129 engages the upper end of the tubular member 115 and forces it down to force the fluke 105 outward into the earth. The length of the pistons 125 and the length of the tube 115 are such that when the pistons 125 are forced out of their cylinders 121 to their maximum outward positions, the bottom of the ring 101 will not engage the top of the coupling member 49.

After the flukes 105 have been expanded out into the earth formation around to the hole 111, the nut 123 is removed from the rod 23 and the hydraulic cylinder assembly 117 is also removed from the rod 23. The upper end member 41 then is screwed to the upper end of the rod 23 and to the coupling member 47 whereby the fluid tight chamber 53 is formed. The rod 23 will have a length such that the inlets 61 and 63 will be located above the surface of the earth when the hole is filled with soil.

Figure 5:
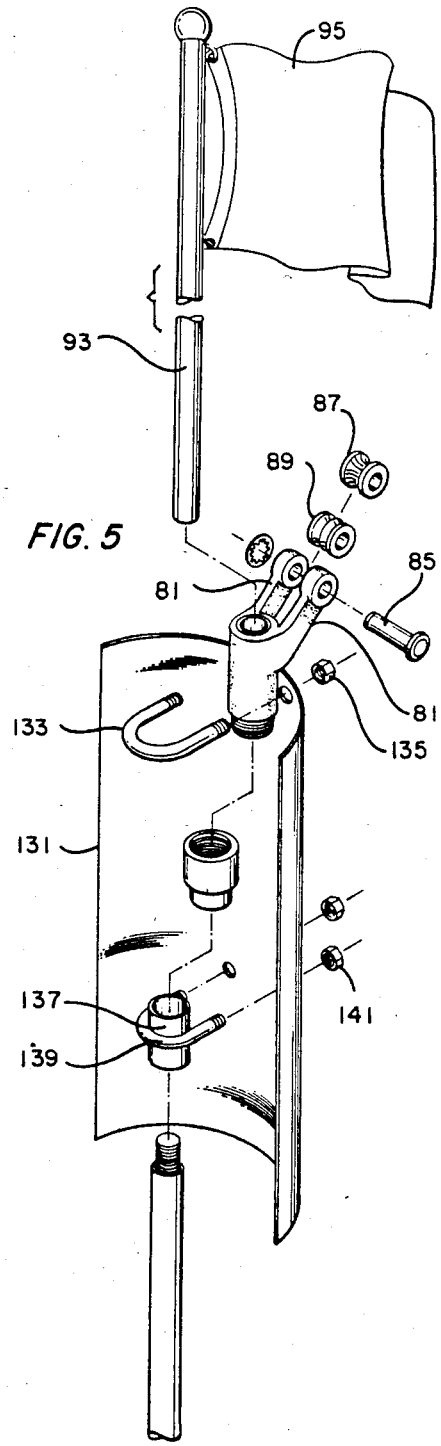
FIG. 5 is an exploded view of the upper portion of the anchor.
Figure 6:
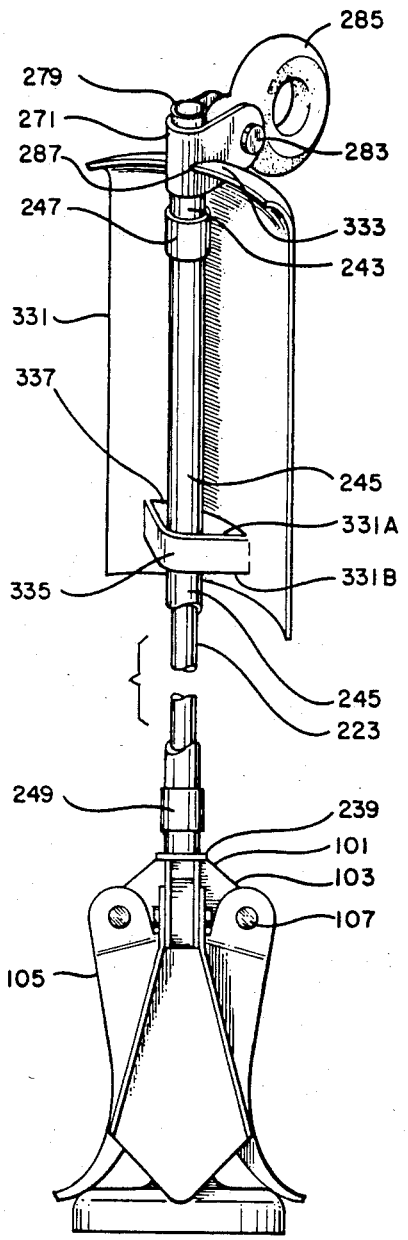
FIG. 6 is another embodiment of the earth anchor of the present invention with its flukes in a retracted position.
Figure 7:
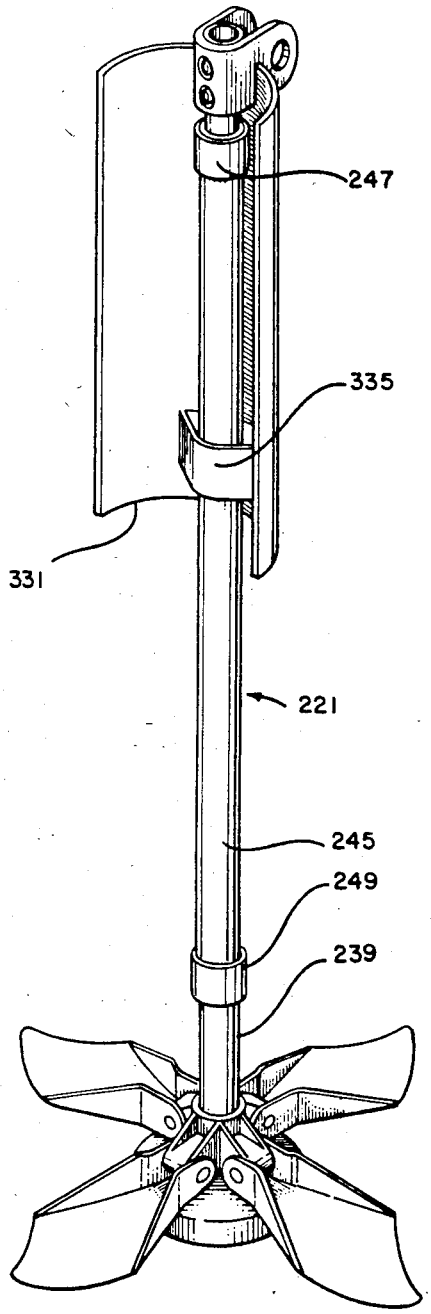
FIG. 7 illustrates the anchor of FIG. 6 with its flukes in an expanded position.

Before the hole 111 is filled with soil, an enlarged bushing plate 131 is attached to the tubular member 41 with a U-bolt 133 and nuts 135 and to the rod 23 at a lower position, by way of the sleeve 45, with a metal ring 137 and a U-bolt 139 and nuts 141. The bushing plate 131 may be flat or semicircular as shown in FIGS. 4 and 5. With the U-bolt attaching arrangement, the plate 131 will be located to one side of the rod 23 of the anchor with the length of the plate 131 generally parallel to the length of the rod 23 as shown in FIG. 4. Preferably the width of the plate 131 will be slightly less than the diameter of the hole 111 and it will have a length preferably greater than its length. After the bushing plate 131 is secured in place, the hole 111 then is filled with earth to a level such that the inlets 61 and 63 are located above the earth 112 with the top of the plate 131 located at or slightly below the earth as shown in dotted lines in FIG. 1B.

The purpose of the sleeve comprising the lower portion 43C of the upper member 41, the plastic sleeve 45 and coupling members 47 and 49 and tubular extension 39 of the reaction member 33 is to protect the steel rod 23 from corrosive action of the soil as well as from the effects of electrical currents within the coil. After the anchor has been secured in place and before or after the hole is filled with soil, the plug 65 is removed and the chamber 53 filled with a liquid such as light oil or a water soluble fluid such as ethylene-glycol which will not freeze in colder climates. The plug 65 then is inserted to seal the inlet 61 and an inert gas such as nitrogen, freon, or carbon dioxide is injected under pressure through the opening 69 to maintain the liquid in the chamber 53 under pressure at all times so as to expell the liquid into the soil at points of possible breaks in the PVC pipe to provide resistance to moisture in the soil in the area of any breaks and to keep moisture from entering the PVC pipe and damaging the anchor rod. With the inlets 61 and 63 located above the surface of the earth, the operators can periodically check the gas pressure in the chamber through the inlet 69 with a suitable gauge to determine whether any leaks have occurred. If leaks have occurred, additional liquid and gas under pressure can be injected into the chamber or the anchor can be marked for repair at a later date. It is to be understood that in some cases it may be desirable to use only an inert gas under pressure in the chamber 53 rather than a gas under pressure over a liquid. The pressure of the inert gas can be tested to determine if leaks have occurred. In addition, it is to be understood that a protective liquid only can be used in the chamber 53.

The purpose of the bushing plate 131 is to allow the anchor to be installed in a vertical hole (which is the cheapest hole to form) and which will be at an angle relative to the guy wire to be attached to the top of the anchor and to the structure to be supported. The anchor will be secured in the hole such that the arms 81 will extend in the direction of the guy wire or wires attached to spools 87 or 89. The end member 41 transfers the force of the load at the surface to the rod 23 and the bushing plate 131 transfers the force of the load to the wall of the hole thereby eliminating the need of the hole being required to be non-vertical and in alignment with the guy wire attached from the anchor to the structure to be supported. The bushing plate is coupled to the rod 23 by the rigid and strong end member 41 at the top of the rod 23 and at a lower position well below the end member 41 which keeps the rod 23 from arcing as the load is applied to the arms 81 of the end member 41. The purpose of the rod 93 and flag 95 is to mark the position of the anchor when installed.

In one embodiment, the anchor is used to anchor large towers employed for supporting electrical power and transmission lines. It is to be understood that the anchor can be used for many other purposes that require support for large loads above the surface of the earth. Since the anchor is to be secured in a vertical hole, the hole can be easily drilled and the anchor easily secured in the hole with the use of the expandible flukes 105.

The use of the inlets 61 and 63 for maintaining a liquid under pressure in the chamber 53 is desirable in anchors employed for supporting large structures such as towers used for supporting electrical power and transmission lines in remote areas since in these instances, maintenance is difficult and it is desirable to maintain the anchor for periods as long as, for example, fifty years. For purposes of supporting other small or large structures in areas close to or in cities, maintenance of the anchor can be more readily carried out and in these instances, it may not be as important to maintain a liquid under pressure in the chamber 53. In this embodiment, it is not necessary for the upper end member 41 to have the inlets 61 and 63 for injecting liquid and gas under pressure into the chamber. The sealed chamber 53, however, still will be employed and protection to the rod 23 still will be available since it will be sealed from the earth by the end member 41, the plastic sleeve 45 with the coupling members 47 and 49, the extending tubular member 39 and the reaction member 33.

A less expensive anchor can be built that does not have the sealed chamber around the rod 23. In this embodiment, the plastic sleeve 45 and plastic coupling members 47 and 49 will not be employed. In addition the inlets 61 and 63 will not be formed through the member 41. Everything else of the anchor will be the same. The anchor of this embodiment may not last as long, however, it will have short term usefulness.

In one embodiment for use in a hole having a diameter of about 10 inches and a depth of 6 feet, the rod 23 may have a diameter of 1 inch and a length of about 6 feet. The bushing plate 131 in this embodiment may be formed from a steel plate 20 inches long, 10 inches wide, and 3/16 of an inch thick. It will be bent in an arc having a radius of 5 inches such that its resulting width will be about 8½ inches. Such a plate will transfer to the hole wall one-half of the vertical load resulting from a 45° pull relative to the surface of the earth. Since the plate 131 is semicircular, its outer convex side can be located next to the wall of the hole on the load side thereof eliminating the need of tamping the soil in the hole between the plate and the wall of the hole which would be required for example if the plate 131 were flat instead of formed in a semicircle. The semicircular plate 131 can be moved next to the side of the wall of the hole due to the fact that the rod 23 is long and flexible. It is to be understood, that the bushing plate could be flat although if a flat plate were employed, it would be required to be thicker than the plate that is formed in a semicircle. The bushing member 131 may be connected to the rod 23 at positions such that the U-bolts 133 and 139 will be about 12 inches apart. In this embodiment, the ring 101 and the flukes 105 will be formed of steel with the flukes 105 each having a length of about 10½ inches. The length from the pin 107 to the outward tip of the flukes 105 will be 9 inches. The distance between opposite pins 107 will be 5 inches. For a rod 23 having an outside diameter of 1 inch, the PVC pipe or sleeve 45 used may be 1 inch schedule 40. The wall thickness of sleeve 45 is ⅛ of an inch. Such a PVC pipe will have an inside diameter slightly greater than 1 inch with a clearance of about 0.025 of an inch on each side of the rod 23. Such a clearance is sufficient to form a suitable sealed chamber 53 for a liquid under pressure if it desired to put liquid under pressure within the chamber 53.

Referring now to FIGS. 6–10, there will be described another embodiment of the anchor of the present invention. This anchor is similar to that of FIGS. 1–5 except that the lower reaction member and the upper member to which the plastic sleeve is connected are welded to the main support rod. The anchor of FIGS. 6–10 is identified at 221. It comprises an elongated steel rod 223, circular in cross section, with a lower end 225 and an upper end 227. The lower end 225 is located in a central aperture 229 of a reaction member 231 and welded therein at 233. The weld 233 forms a seal between the lower end 225 of the rod 223 and the reaction member 231. The reaction member 231 has a radially outward extending wall 235 with an outer annular edge 235A formed between the radially extending wall 235 and a cylindrical portion 237. A tubular member 239 has its lower end welded at 240 to the top lip 241 of the reaction member 231. The weld 240 forms a seal between the lower end of tubular member 239 and the top lip 241 of reaction member 231. The inside wall of the tubular member 239 above the weld 240 is spaced from the rod 223.

A tubular end member 243 is welded at 244 to the upper end 227 of the rod. The weld forms a seal between the tubular member 243 and the upper end 227 of the rod 223. The inside wall of the tubular member 243 below the weld 244 is spaced from the rod 223. The tubular member 239 has upper threads 239A and the tubular member 243 has lower threads 243A. A plastic sleeve comprising an elongated plastic tubular member 245 having its upper end secured to an upper plastic coupling member 247 and its lower end secured to a lower plastic coupling member 249 is located around the rod 223. The lower coupling member 249 is screwed to the threads 239A of the tubular member 239 and the upper coupling member 247 is screwed to the threads 243A of the tubular member 243 with fluid tight connections being formed. Preferably the sleeve 245 and coupling members 247 and 249 are formed of PVC. The coupling members 247 and 249 are secured around the upper and lower ends of the sleeve 245 with the use of a suitable sealing or bonding agent to form fluid tight joints. A suitable sealing agent is used between the threaded connections of the coupling member 249 and the threads 239A of the tubular member 239 and between the threaded connection of the coupling member 247 and the threads 243A of the tubular member 243. End member 243, reaction member 231, and tubular member 239 are formed of steel. The inside wall of the lower portion of the tubular member 243, the inside wall of the coupling member 247, the inside wall of the sleeve 245, the inside wall of the coupling member 249, and the inside wall of the tubular member 239 are spaced from the rod 223 such that a sealed chamber 253 is formed between the rod 223 and the lower portion of tubular member 243, coupling member 247, sleeve 245, coupling member 249, and tube 239.

Lower and upper inlets 261 and 263 are formed through the wall of the lower portion of the tubular member 243 such that the inlets 261 and 263 are in fluid communication with the sealed chamber 253. The inlet 261 normally is sealed with a metal plug 265 screwed into the inlet 261. The inlet 263 normally is sealed with a plug 267 which is screwed into the inlet 263. Plug 267 is the same as plug 67 and has an opening formed therethrough with a normally closed check valve located therein such that gas under pressure can be injected into the sealed chamber 253 by way of the opening and normally closed check valve in the plug 267.

Inlets 261 and 263 are used in the same manner as inlets 61 and 63 for injecting a protective liquid and gas under pressure into the sealed chamber 253. A U-shaped member 271 having holes 273 and 275 for the plugs 265 and 267 is welded at 277 to the tubular member 243 with the tubular member 243 located between the arms 271A and 271B of the U-shaped member 271 with the plugs 265 and 267 extending through the holes 273 and 275. A small tube 279 is welded at 281 to the top of the U-shaped member 271 for receiving the rod of an anchor marker. The arms 271A and 271B of the U-shaped member 271 have apertures 271C and 271D formed therethrough for receiving a bolt 283 for pivotally connecting an eye member 285 thereto to which a guy wire or cable is to be connected. The U-shaped member 271, the bolt 283, and the eve member 285 are defined as a connecting means to which a guy wire is to be connected.

A semi-circular load transfer plate 331 is welded to the U-shaped member 271 at 333 and is coupled to the rod 223 at a lower position. The lower connection is formed by forming two slits 331A and 331B in the load transfer plate 331 and bending the resulting tab 335 outward to form an aperture 337 in which the rod 223 including the sleeve 245 is inserted. At the lower end of the anchor, the ring shaped member 101 with flukes 105 is located around the tubular member 239. The ring 101 and the flukes 105 is the same as that of FIG. 1B. In this respect, supporting ears 103 extend outward from the ring 101 and pivotally support flukes 105 by pins, 107.

In assembling the anchor of FIGS. 6–10, the ring 101 with its flukes 105 is located around the tube 239 before the PVC sleeve 245 with its lower coupling member 249 is connected to the threads 239A of the tube 239. Lower coupling member 249 connected to sleeve 245 is screwed to tubular member 239 and the sleeve 245 connected to upper coupling member 247 is inserted through the aperture 337 of plate member 331. Tubular member 243 is located around the upper end 227 of rod 223 and screwed into the coupling member 247. The tube 243 next is welded to the upper end 227 of the rod 223. The U-shaped member 271 is welded to the tubular member 243 and the anchor marker tube 279 is welded to the top of the U-shaped member 271. The load transfer plate 331 has an upper slot 287 formed therein for receiving the U-shaped member 271. The U-shaped member 271 is located in the slot 287 and the load transfer plate 331 is welded to the U-shaped member 271 at 333. A plastic coating 289 preferably is applied to the lower end 225 of the rod 223 for protection purposes.

In cases where a liquid and gas under pressure are not employed in the sealed chamber 253, it is not necessary for the tubular member 243 to have the inlets 261 and 263.

A less expensive anchor can be built that does not have the sealed chamber around the rod 223. In this embodiment the plastic sleeve 245 and plastic coupling members 247 and 249 will not be employed. In addition, the inlets 261 and 263 will not be formed through the member 243. Everything else of the anchor will be the same. The anchor of this embodiment may not last as long, however, it will have short term usefulness.

In securing the anchor to a hole formed in the earth, the complete unit is lowered into the hole, with the flukes 105 in their retracted positions, until the reaction member 231 rests on the bottom of the hole. A special expanding device is employed which grips the U-shaped member 271 and then applies pressure to the top of the ring 101 to expand the flukes 105 outward into the earth surrounding the hole.

I claim:

1. An anchor adapted to be located in a generally vertical hole formed in the earth and substantially covered with earth, comprising:

elongated rod means having a first end and a spaced second end, said first end of said rod means being adapted to be located at the lower end of a hole formed in the earth, connecting means coupled to said second end of said rod means and adapted to be located above the earth when the anchor is secured in place, said connecting means being adapted to have a guy wire connected thereto for extension upward from said anchor to other structure, for support purposes along a line which is not aligned with the axis of said rod means and which intercepts the axis of said rod means, end means coupled to said first end of said rod means and extending transversely outward therefrom, support means having a plurality of flukes pivotally coupled thereto, said support means being adapted to be located around said rod means near said first end of said rod means and moved toward said first end of said rod means near said end means such that said flukes will engage said end means and be pivoted outward into the earth surrounding the hole as said support means is moved further toward said first end of said rod means, and an enlarged plate means coupled by coupling means to said rod means near said second end and at a position between said second end and said first end of said rod means for transferring a portion of a load, applied by the guy wire to said connecting means, to the wall of the hole, said plate means having a width much greater than the maximum dimension of said rod means in a plane perpendicular to the length of said rod means and a length greater than its width, said plate means being located on one side of said rod means with its length being generally parallel with the length of said rod means, said coupling means preventing said plate means from moving transversely to the axis of said rod means.

2. The anchor of claim 1, wherein:

said plate means is formed generally in a semicircle with its axis being generally parallel to the length of said rod means.

3. The anchor of claim 1, wherein:

said connecting means has an aperture for receiving the guy wire for connection to said connecting means, the center of said aperture being offset from the axis of said rod means.

4. The anchor of claim 3, wherein:

said connecting means is removably coupled to said second end of said rod means.

5. The anchor of claim 3, wherein:

said plate means is located next to said rod means.

6. The anchor of claim 5 wherein:

said coupling means comprises upper and lower means for coupling the upper and lower ends of said plate means to said rod means, at least said lower means extends partially around said rod means.

7. The anchor of claim 1, wherein:

said plate means is located next to said rod means.

8. The anchor of claim 7, wherein:

said coupling means comprises upper and lower coupling means for coupling the upper and lower ends of said plate means to said rod means, at least said lower means extends partially around said rod means.

9. The anchor of claim 1, wherein:

said rod means comprises a solid metal rod having said first and second ends.

10. The anchor of claim 1, wherein:

said rod means comprises a solid metal rod having said first and second end, structure coupled to said second end of said rod, said connecting means being connected to said structure, said coupling means comprises upper and lower means, said upper means coupling the upper end of said plate means to said structure, said lower means coupling the lower end of said plate means to said rod means below said structure.

11. The anchor of claim 10, wherein:

said structure is removably coupled to said second end of said rod.

12. An anchor adapted to be located in a generally vertical hole formed in the earth and substantially covered with earth, comprising:

elongated rod means having a first end and a spaced second end, said first end of said rod means being adapted to be located at the lower end of a hole formed in the earth, connecting means coupled to said second end of said rod means and adapted to be located above the earth when the anchor is secured place, said connecting means being adapted to have a guy wire connected thereto for extension upward from said anchor to other structure, for support purposes along a line which is not algined with the axis of said rod means and which intercepts the axis of said rod means, end means coupled to said first end of said rod means and extending transversely outward therefrom, sleeve means located around said rod means and extending from said end means to said second end of said rod means forming a sealed chamber around said rod means, a support means having a plurality of flukes pivotally coupled thereto, said support means being adapted to be located around said sleeve means near said first end of said rod means and moved toward said first end of said rod means near said end means such that said flukes will engage said end means and be pivoted outward into the earth surrounding the hole as said support means is moved further toward said first end of said rod means, an enlarged plate means coupled by coupling means to said rod means near said second end and at a position between said second end and said first end of said rod means for transferring a portion of a load applied by the guy wire to said connecting means to the wall of the hole, said plate means having a width much greater than the maximum dimension of said sleeve means in a plane perpendicular to the length of said rod means and a length greater than its width, said plate means being located on one side of said rod means with its length being generally parallel with the length of said rod means, said coupling means preventing said plate means from moving transversely to the axis of said rod means.

13. The anchor of claim 12, wherein:

said plate means is formed generally in a semicircle with its axis being generally parallel to the length of said rod means.

14. The anchor of claim 12, wherein:

said connecting means has an aperture for receiving the guy wire for connection to said connecting means, the center of said aperture being offset from the axis of said rod means.

15. The anchor of claim 14, wherein:

said connecting means is removably coupled to said second end of said rod means.

16. The anchor of claim 14, wherein:
said plate means is located next to said rod means.
17. The anchor of claim 16, wherein:
said coupling means comprises upper and lower means for coupling the upper and lower ends of said plate means to said rod means,
at least said lower means extends partially around said sleeve means.
18. The anchor of claim 12, wherein:
said plate means is located next to said rod means.
19. The anchor of claim 18, wherein:
said coupling means comprises upper and lower means for coupling the upper and lower ends of said plate means to said rod means,
at least said lower means extends partially around said sleeve means.
20. The anchor of claim 12, wherein:
said rod means comprising a solid metal rod,
structure removably coupled around said second end of said rod and to the upper end of said sleeve means
said connecting means being connected to said structure,
said coupling means comprises upper and lower means,
said upper means coupling the upper end of said plate means to said structure,
said lower means coupling the lower end of said plate means to said sleeve means.
21. The anchor of claim 20, wherein:
said upper and lower means comprise U-bolts adapted to fit around said structure and around said sleeve means respectively and to be removably coupled to said plate means.
22. The anchor of claim 20, wherein:
said sleeve means is formed of plastic material,
said upper means being removably coupled to said upper end of said plate means and to said structure,
said lower means being removably coupled to said lower end of said plate means and to said sleeve means.
23. The anchor of claim 22, wherein:
said rod is prevented by structure from moving relative to said sleeve means.
24. The anchor of claim 12, wherein:
said rod means comprises a solid metal rod,
structure fixedly secured to said second end of said rod,
the upper end of said sleeve means being coupled to the lower end of said structure,
said connecting means being connected to said structure,
the lower end of said plate means being coupled to said sleeve means.
25. The anchor of claim 24, wherein:
said rod is prevented by structure from moving relative to said sleeve means.
26. The anchor of claim 23, wherein:
said sleeve means is formed of plastic material.

* * * * *